US005291618A

United States Patent [19]

Chiang

[11] Patent Number: 5,291,618

[45] Date of Patent: Mar. 8, 1994

[54] AUTOMATIC TOILET SEAT LIFT MECHANISM

[76] Inventor: Yueh-Tse Chiang, Fl. 5, No. 4, Lane 781, Sec. 2, Kuo Kuang Rd., Ta Li Hsiang, Taichung Hsien, Taiwan

[21] Appl. No.: 49,296

[22] Filed: Apr. 20, 1993

[51] Int. Cl.[5] ..... A47K 13/10

[52] U.S. Cl. ..... 4/241; 4/246.2

[58] Field of Search ..... 4/236, 240, 241, 246.1, 4/246.2, 246.3

[56] References Cited

U.S. PATENT DOCUMENTS 1,291,125 1/1919 Pope ..... 4/246.2

2,352,133 6/1944 Sperzel et al. ..... 4/241

FOREIGN PATENT DOCUMENTS 0027643 10/1909 Fed. Rep. of Germany ..... 4/246.2

*Primary Examiner*—Robert M. Fetsuga

*Attorney, Agent, or Firm*—Bacon & Thomas

[57] ABSTRACT

An automatic toilet seat lift mechanism including torsional springs to retain the toilet seat in the vertical position, a rod inserted in a rubber bushing in a hole on the toilet bowl with its bottom end coupled to a gate in front of the water outlet of the flush pipe and its top end stopped against a stop plate on the toilet seat, whereby the rod stops against the stop plate at the bottom to hold the toilet seat in the horizontal position covered on the toilet bowl; flushing the toilet causes the rod to release the stop plate for permitting the toilet seat to be lifted to the vertical position by the torsional springs.

1 Claim, 2 Drawing Sheets

AUTOMATIC TOILET SEAT LIFT MECHANISM

BACKGROUND OF THE INVENTION

The present invention relates to a lift mechanism for a toilet which automatically lifts the toilet seat from the toilet bowl each time the toilet bowl is flushed.

The toilet seat must be lifted from the toilet bowl after each service so as to prevent contamination. However, people may forget or are unwilling to lift the toilet seat after each use. There are various automatic lift mechanisms manufactured for lifting the toilet seat automatically. However, these automatic toilet seat lift mechanisms are commonly expensive, and they are sold with toilet bowls together. Therefore, these automatic toilet seat lift mechanisms are not suitable for existing toilet bowls.

SUMMARY OF THE INVENTION

It is one object of the present invention to provide an automatic toilet seat lift mechanism which is simple in structure and inexpensive to manufacture. Another object of the present invention is to provide an automatic toilet seat lift mechanism which can be conveniently installed in any of a variety of existing toilet bowls. The present invention uses torsional springs to retain the toilet seat in the vertical position, and a gate to control the position of a rod, which stops the toilet seat in the horizontal position covered on the toilet bowl. Each time the toilet bowl is flushed, the gate is moved to turn the rod slightly clockwise in releasing the toilet seat, and therefore the toilet seat is immediately lifted from the toilet bowl by the torsional springs to the vertical position.

DETAILED DESCRIPTION OF THE PREFERRED EMBODIMENT

Figure 1:
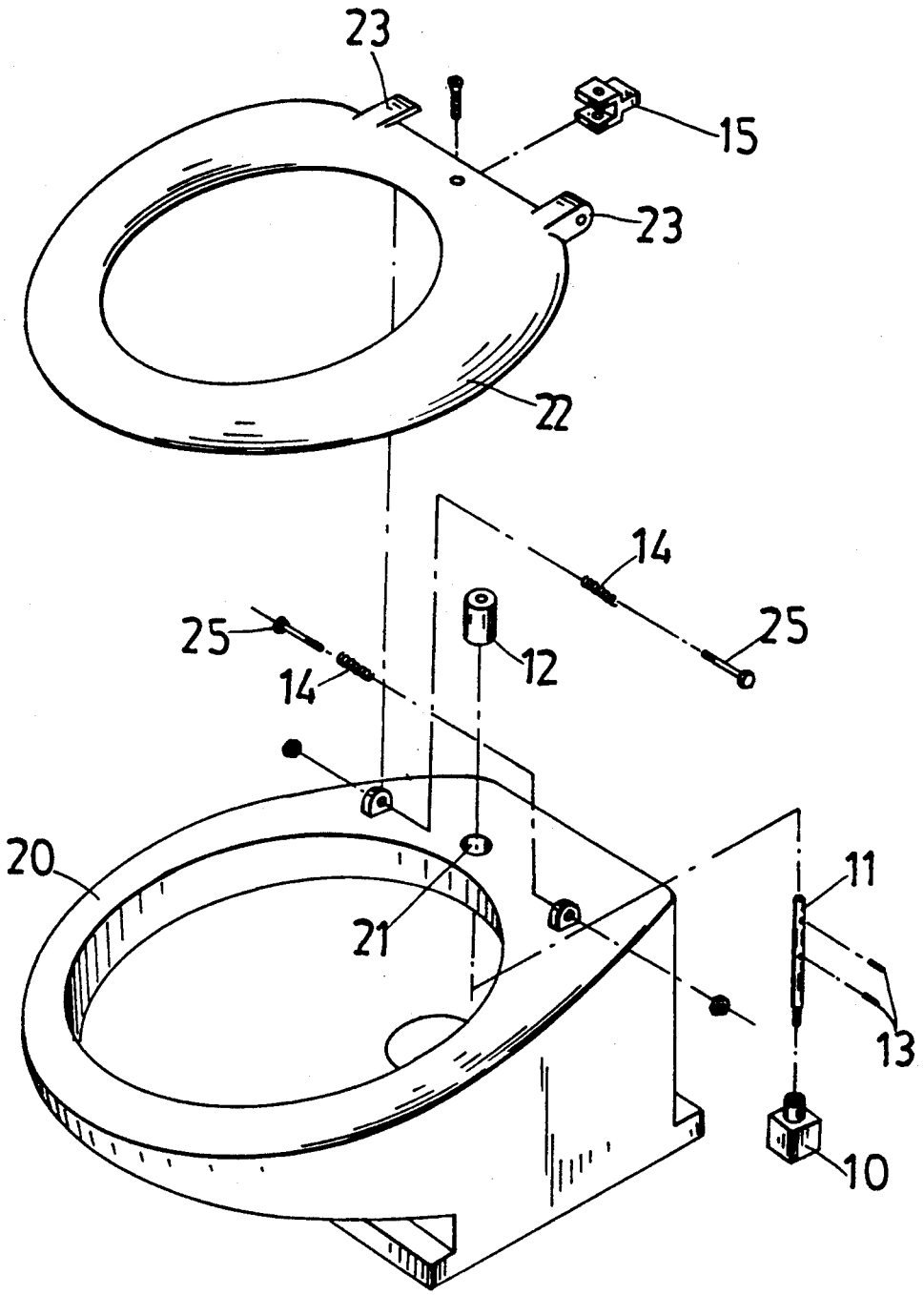
FIG. 1 is a perspective exploded view of an automatic toilet seat lift mechanism embodying the present invention.
Figure 2:
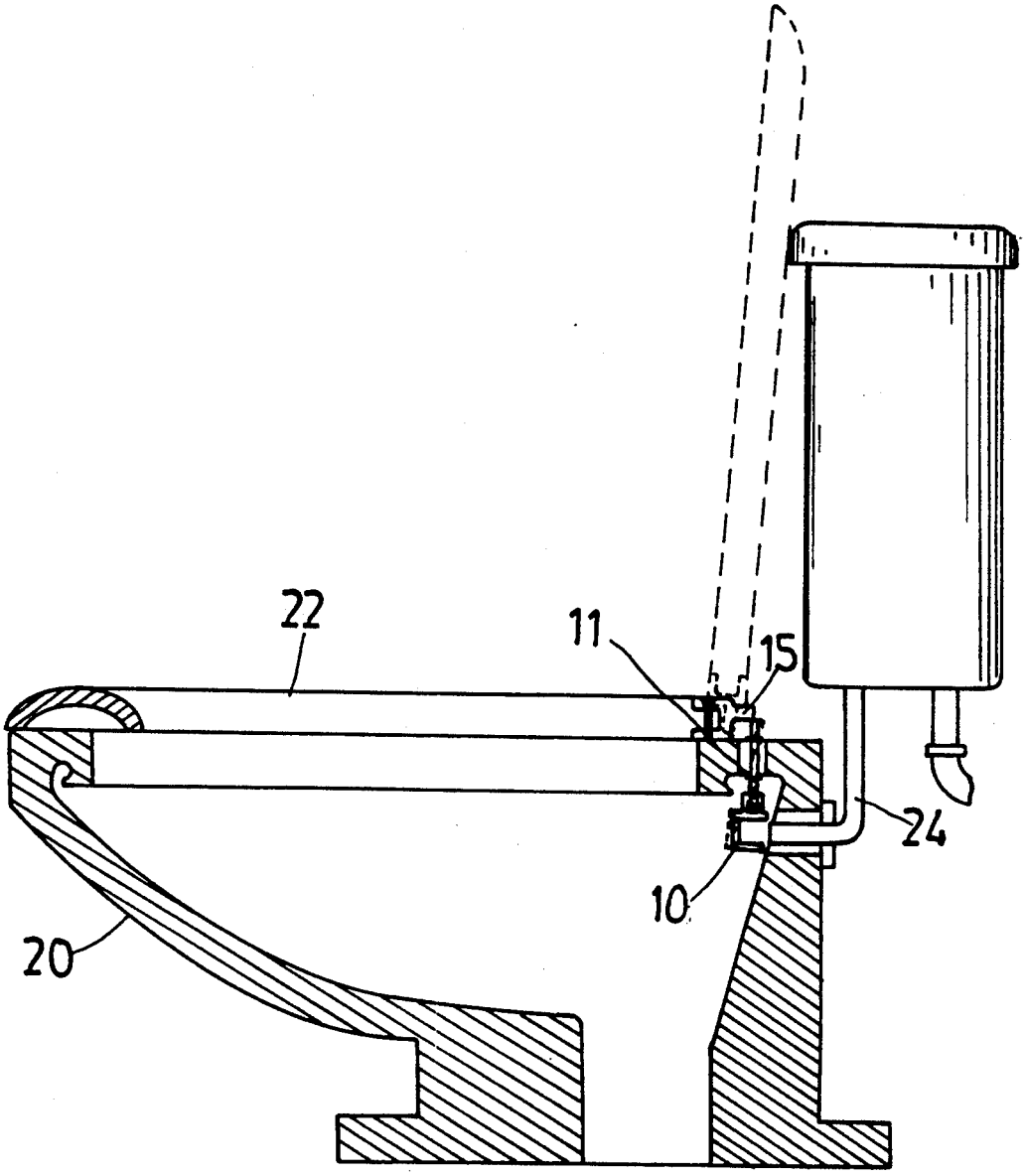
FIG. 2 is a schematic drawing showing the operation of the automatic toilet seat lift mechanism in lifting the toilet seat.

Referring to FIGS. 1 and 2, an automatic toilet seat lift mechanism in accordance with the present invention is generally comprised of a gate 10, a rod 11, a rubber bushing 12, two locating pins 13, two torsional springs 14, and a stop plate 15. The rubber bushing 12 is inserted in a through hole 21 on the toilet bowl 20 at the top near the back. The rod 11 is inserted into the rubber bushing 12, having a bottom end fastened to the gate, 10 through a screw joint. The gate 10 is disposed adjacent to the output end of the flush pipe 24 of the toilet. The two locating pins 13 are respectively inserted through holes on the rod 11 at different elevations, one above the rubber bushing 12 and the other below the rubber bushing 12, and therefore the rod 11 is retained to the rubber bushing 12. The stop plate 15 is fastened to the toilet seat 22 at the back. Two pivot pins 25 are respectively inserted through lugs 23 on the toilet seat 22 to pivotally fasten the toilet seat 22 to the toilet bowl 20. The two torsional springs 14 are respectively mounted on the pivot pins 25, each having one end fixed to the respective pivot pin 25 and an opposite end fixed to the respective lug 23. As the toilet seat 22 covers on the toilet bowl 20, the top end of the rod 11 is stopped against the stop plate 15 to surpass the spring force of the torsional springs 14. As the flush handle of the toilet is turned to send a sudden rush of water from the water tank to the toilet bowl 20, the gate 10 is moved by the sudden rush of water to turn the rod 11 slightly clockwise, causing the rod 11 to release the stop plate 15. Once the stop plate 15 is released from the rod 11, the toilet seat 22 is immediately lifted from the toilet bowl by the spring force of the torsional springs 14.

While only one embodiment of the present invention has been shown and described, it will be understood that various modifications and changes could be made thereunto without departing from the spirit and scope of the invention. For example, the stop plate may be integrally made on the toilet seat.

I claim:

1. An automatic toilet seat lift mechanism for use with a toilet having a toilet bowl, a flush pipe having an outlet for supplying flushing water to an interior of said toilet bowl and a toilet seat pivotally mounted to a rear upper portion of said toilet bowl to move between horizontal and vertical positions, said automatic toilet seat lift mechanism comprising:

a rubber bushing adapted to be fitted into a through hole in said rear upper portion of said toilet bowl;

a rod inserted through said rubber bushing and retained thereto by at least one locating pin, said rod having a lower end portion sized to extend into said toilet bowl;

a gate fastened to said lower end portion of said rod and adapted to be disposed adjacent said water outlet of said flush pipe;

a stop plate adapted to be fastened to said toilet seat and being selectively engaged with an upper end of said rod; and spring means for lifting said toilet seat to said vertical position from said horizontal position;

whereby said rod engages said stop plate when said toilet seat is in said horizontal position to hold said toilet seat in said horizontal position against the bias of said spring means; flushing water into said toilet bowl causes said gate to move said rod to release said stop plate for permitting said toilet seat to be lifted to said vertical position by said spring means.

* * * * *